United States Patent [19]

Forsberg

[11] 3,966,334

[45] June 29, 1976

[54] ADHESIVE APPLICATOR DEVICE AND METHOD

[75] Inventor: Charles W. Forsberg, Shaker Heights, Ohio

[73] Assignee: Indian Head Inc., New York, N.Y.

[22] Filed: Feb. 6, 1975

[21] Appl. No.: 547,391

[52] U.S. Cl. ..... 401/9; 128/269; 401/198

[51] Int. Cl.[2] ..... A46B 15/00

[58] Field of Search ..... 401/118–130, 401/9, 11, 198, 199; 128/269; 15/244

[56] References Cited

UNITED STATES PATENTS

| | | | |
|---|---|---|---|
| 2,043,678 | 6/1936 | Schmalz | 128/269 |
| 2,491,274 | 12/1949 | McNeill | 128/269 |
| 2,510,490 | 6/1950 | Ager | 128/269 |
| 2,810,145 | 10/1957 | Forrow | 401/119 X |
| 3,214,780 | 11/1965 | Sharpe | 401/9 |
| 3,818,911 | 6/1974 | Fournier | 401/198 X |
| 3,861,810 | 1/1975 | Vasas | 401/122 |

FOREIGN PATENTS OR APPLICATIONS

| | | | |
|---|---|---|---|
| 1,579,503 | 7/1969 | France | 15/244 R |

*Primary Examiner*—Lawrence Charles
*Attorney, Agent, or Firm*—Laney, Dougherty, Hessin & Fish

[57] ABSTRACT

An adhesive applicator device including an elongated shaft x-shaped in section formed by the intersection of a pair of webs at a right angle. The webs have tapered end edges, so that the shaft is characterized in having a point at one end thereof where the tapered edges of the webs converge. Each web has a plurality of spaced V-shaped notches therein. The notches extend into the web in the direction of the tapered end edges, with the innermost portion of each notch nearer to the tapered edge of the web than to the opening of the respective notch. At the end of the shaft opposite its pointed end, the shaft is secured to a mounting plate. Pressed over the shaft by extension of the intersecting webs into a slot of x-shaped cross section formed therein is a cylindrical applicator pad formed of a cellular porous resilient material.

The method of the invention comprises absorbing adhesive in the open cells of the resilient applicator pad, then moving the pad in a circular movement, without rotating it about its longitudinal axis, around the end of a pipe, or fitting, so that adhesive is transferred from the pad to the external or internal surface of the pipe or internal surface of the fitting. The pipe or fitting is retained stationary during adhesive application.

12 Claims, 3 Drawing Figures

ADHESIVE APPLICATOR DEVICE AND METHOD

BACKGROUND OF THE INVENTION

1. Field of the Invention

This invention relates to manual applicator devices for applying an adhesive to a cylindrical object, and more particularly, to dauber type, manual adhesive applicators in which adhesive is transferred from the swab or dauber carrying the adhesive to the surface of a cylindrical object, such as a pipe, conduit or fitting.

2. Brief Description of the Prior Art

A number of variously constructed manual adhesive applicator devices have been heretofore proposed, and many of these have been marketed. Of the various types that have been patented, several include an elongated shaft having a handle at one end thereof, and having a swab or adhesive-carrying material wrapped around the shaft over some portion of its length for the purpose of adsorbing and carrying adhesive to be transferred to an object which is to be glued or adhered to another object. Such patents include U.S. Pat. No. 2,510,490 to Ager, U.S. Pat. No. 2,043,678 to Schmalz, and U.S. Pat. No. 1,962,875 to Reber. Related devices used as swabs, or for transferring paint to an object, include those described in U.S. Pat. No. 2,491,274 to McNeil, U.S. Pat. No. 1,682,657 to Blank, and U.S. Pat. No. 3,228,398 to Leonard, et al.

One of the problems which has been encountered with dauber type manual cement or adhesive applicators is that the dauber generally carries an insufficient quantity of cement or adhesive to permit complete and thorough application, with one manual movement, to the external or internal cylindrical surface at the end of a pipe which is to be jointed to another pipe section by a male or female connection, or when a fitting is to be joined to a pipe. As a result, several movements are required between the container containing the supply of adhesive and the pipe or fitting surface in order to complete the application of the adhesive thereto. Previous adhesive daubers require repetitive movement to insure uniform distribution of the adhesive on the surface of the pipe or fitting. Further, in some instances, the absorbent adhesive-carrying material which is positioned around a rigid shaft of the manual applicator has been able to slip around on the shaft in a rotating motion upon frictional contact with the surface to which the adhesive is to be applied, with the result that the point of contact on such absorbent material of the member to which the adhesive is to be applied remains the same, and the result is that little of the adhesive carried by other parts of the absorbent material is transferred to the surface to which the adhesive is to be applied. The described ability of the absorbent material to turn on the shaft which carries it also results in a nonuniform application of adhesive at various locations around the periphery of the cylindrical surface to which the adhesive is to be applied.

BRIEF DESCRIPTION OF THE PRESENT INVENTION

The present invention provides an improved adhesive applicator device which is used for manually distributing adhesive over a cylindrical surface, and is particularly useful for transferring a fairly viscous adhesive substance to the outer or inner peripheral surface of the end of a pipe, tubing or other conduit and the inner surface of a fitting. The adhesive applicator device bears some superficial similarity to those previously in use, but is improved in the specific manner in which it is constructed to allow a much higher degree of adhesive loading on a porous adhesive carrying portion of the device, so that a very substantial quantity of adhesive can be transferred to the member to be coated with the adhesive. Moreover, the device is constructed so as to be durable during its operating life.

Broadly described, the adhesive applicator device of the invention comprises a handle portion, a shaft portion and a porous applicator pad. Important in the achievement of the major objectives of the invention is the particular cooperation between the shaft and the porous applicator pad. The shaft is elongated, and is x-shaped configuration in cross-section, such configuration being imparted to the shaft by the intersection at a right angle of a pair of flange-like web members which extend the length of the shaft and which each include beveled or tapered edges at the end of the shaft opposite the handle of the device. The beveled edges converge to a point at one end of the shaft opposite the handle.

Each of the webs which together form the shaft is characterized in having a plurality of serrations, notches or recesses formed therein extending inwardly in the web toward the line of intersection of the two webs at the center of the shaft. The recesses are spaced longitudinally along the respective web, and each recess is inclined in the direction of the pointed end of the shaft. That is to say, each of the recesses is characterized in having an innermost portion (relative to the edge of the web) which is disposed nearer the pointed end of the shaft, or the beveled edge on the respective web, than is the opening of the recess.

Pressed over the shaft of the device is a generally cylindrical applicator pad which is formed of a cellular porous resilient material, such as foamed polyurethane. The applicator pad is formed with an x-shaped slot cut into the pad along the central axis thereof, and such slot receives the shaft of the assembled device. Thus, the cylindrical applicator pad surrounds the shaft and is prevented from turning on the shaft by engagement of the flange-like webs thereof with the x-shaped notch formed along the longitudinal axis of the cylindrical applicator pad. In a preferred embodiment, the shaft does not extend completely through the cylindrical applicator pad, but terminates with its pointed end spaced from one end of the pad.

The invention further relates to a method of applying adhesive to a cylindrical object using the adhesive applicator device of the invention, such method of the invention entailing loading of the adhesive pad with adhesive from an adhesive reservoir, bringing a line along the periphery of the adhesive pad into contact with a tangential line along a cylindrical surface on a pipe, or other member to which the adhesive is to be applied, and then moving the applicator device in a circular motion around the periphery of the pipe or other device without rotating the applicator device about the axis of the shaft, and without turning the pipe about its longitudinal axis.

An important object of the present invention is to provide an improved adhesive applicator device which can be used for manually transferring a substantial quantity of a viscous adhesive material from an adhesive reservoir to a generally cylindrical surface to which the adhesive is to be applied.

A further object of the invention is to provide a manual adhesive applicator device which, when used in conjunction with the method of the invention, will transfer a maximum quantity of adhesive in a uniform manner to a cylindrical surface with minimal necessity to reload the applicator device from the adhesive reservoir during the application of adhesive.

An additional object of the invention is to provide an adhesive applicator device for manual application of adhesive to a cylindrical surface, which device is mechanically durable and strong in construction, and functions well and efficiently over its intended service life.

Additional objects and advantages will become apparent as the following detailed description of a preferred embodiment of the invention is read in conjunction with the accompanying drawings which illustrate the invention.

GENERAL DESCRIPTION OF THE DRAWINGS

FIG. 1 of the drawings illustrates in side elevation, with the adhesive applicator pad shown in section, the adhesive applicator device of the present invention.

DETAILED DESCRIPTION OF PREFERRED EMBODIMENTS OF THE INVENTION

Figure 1:
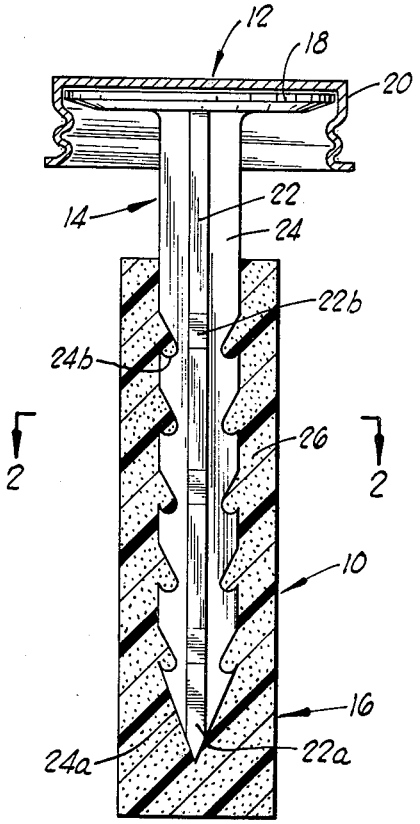

Referring initially to FIG. 1 of the drawings, shown therein is an adhesive applicator device constructed in accordance with the invention, and designated generally by reference numeral 10. The adhesive applicator device 10 includes a handle portion, designated generally by reference numeral 12, a shaft portion designated generally by reference numeral 14, and an absorbent, porous applicator pad designated generally by reference numeral 16. The handle portion 12 includes a disk-shaped mounting plate 18 which is secured by any suitable means to an internally threaded cap 20 adapted for threaded securement to the open end of a jar, bottle or other container which holds an adhesive to be applied by means of the adhesive applicator device of the invention. The shaft 14 is formed of a synthetic resin and is preferably molded integrally with the mounting plate 18 so that the mounting plate and shaft form one unitary member.

Figure 2:
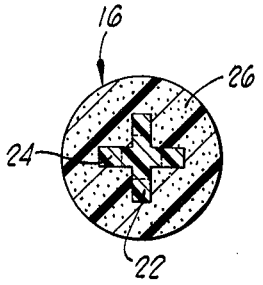
FIG. 2 is a sectional view taken along line 2—2 of FIG. 1.

The shaft 14 is, as shown in FIG. 2 of the drawings, x-shaped in section and is constituted by a pair of intersecting flange-like webs 22 and 24, which webs in the illustrated embodiment, intersect at the longitudinal axis of the shaft in substantially a right angle. Each of the webs 22 and 24 has a tapered end edge at the end thereof opposite the mounting plate 18, such tapered end edges being denominated in FIG. 1 by reference numerals 22*a* and 24*a*. It will be perceived that the beveled or tapered end edges 22*a* and 24*a* of the webs 22 and 24 are convergent with respect to each other so that the end of the shaft opposite the mounting plate 18 tapers to a point.

Each of the webs 22 and 24 is further characterized in having a plurality of longitudinally spaced notches or recesses formed therein and projecting into the web at the longitudinal edge thereof. These recesses, denominated by reference numerals 22*b* and 24*b*, respectively, function for adhesive pad retention, and also as adhesive reservoirs, in a manner hereinafter described. Each of the recesses 22*b* and 24*b* is inclined toward the pointed end of the shaft 14 — i.e., the deepest or innermost portion of each of these recesses is positioned more nearly adjacent to the pointed end of the shaft than is the open mouth of the respective recess. It will also be perceived that the recesses are generally of a V-shaped configuration, being narrower at their innermost ends than at the open mouths thereof.

The adhesive applicator pad 16 is a cylindrical pad of porous, absorbent material which coaxially surrounds the shaft 14. The pad 26 is fabricated, during the manufacture of the adhesive applicator device, with an elongated x-shaped slot formed therein and extending along the longitudinal axis of the pad from one end thereof to a location spaced from the other end thereof. In assembly, the shaft 14 is forced into this x-shaped slot so that the pad 26 receives the shaft and surrounds it in the manner shown in FIGS. 1 and 2. It will be noted that portions of the porous pad 26 tend to expand into and fill the notches 22*b* and 24*b*. It will also be noted that the pad 26 extends past the pointed lower end of the shaft 14 so that this end of the shaft is protected or covered by a portion of the pad.

The described adhesive applicator deivce 10 provides several significant advantages with respect to broadly similar devices which have previously been proposed and used. The porous, cellular absorbent pad 26 which carried the adhesive, and which is preferably constructed of open-celled polyurethane, acts as a wick and loads more cement or adhesive than the type of daubers heretofore in use. The loading is of course, accomplished by placement of the lower portion of the shaft 14 and the adhesive pad in a container holding the adhesive, and generally, the container will have a threaded open end which is closed by screwing the screw cap 20 down thereover. Thus, during placement of the adhesive applicator device in such container, the pad 26 has an opportunity to become fully loaded with the adhesive.

It will further be noted that the serrated or notched characteristic of the webs 22 and 24 which constitute the shaft 14 provide small reservoirs in which some adhesive is stored and retained against gravitational movement down through the device and discharge from the lower end thereof. Further, the applicator device 10 is very sturdy in its construction since the particular way in which the absorbent pad 26 is mounted on the shaft 14, and particularly the way in which the pad 26 cooperates with the notches 22*b* and 24*b* and with the webs 22 and 24, prevents the pad from shifting either upward or downward on the shaft. Rotation of the pad 26 around the axis of the shaft 14 is also prevented by this construction. It will also be noted that the length of the shaft provides continuous support for the pad over a major portion of its length, and that pressure exerted on the pad during application of the adhesive as a result of forcing the shaft toward the surface upon which the adhesive is being applied is fairly well distributed over a major portion of the pad area due to the manner in which the intersecting webs 22 and 24 flare out and extend into symmetrically spaced portions of the pad. The pointed characteristic of the shaft 14 also permits the lower end of the applicator device to be more easily inserted into the open end of a pipe or fitting without difficult forcing, and without a large amount of adhesive being wiped off upon the pipe or fitting surrounding the opening. Finally, the molding of the mounting plate 18 and the shaft 14 as an integral, unitary member provides better anchoring and securement of the mounting plate to the screw cap 20 and prevents the shaft from being broken off or lost out of the screw cap as easily as has occurred with many past constructions.

Figure 3:
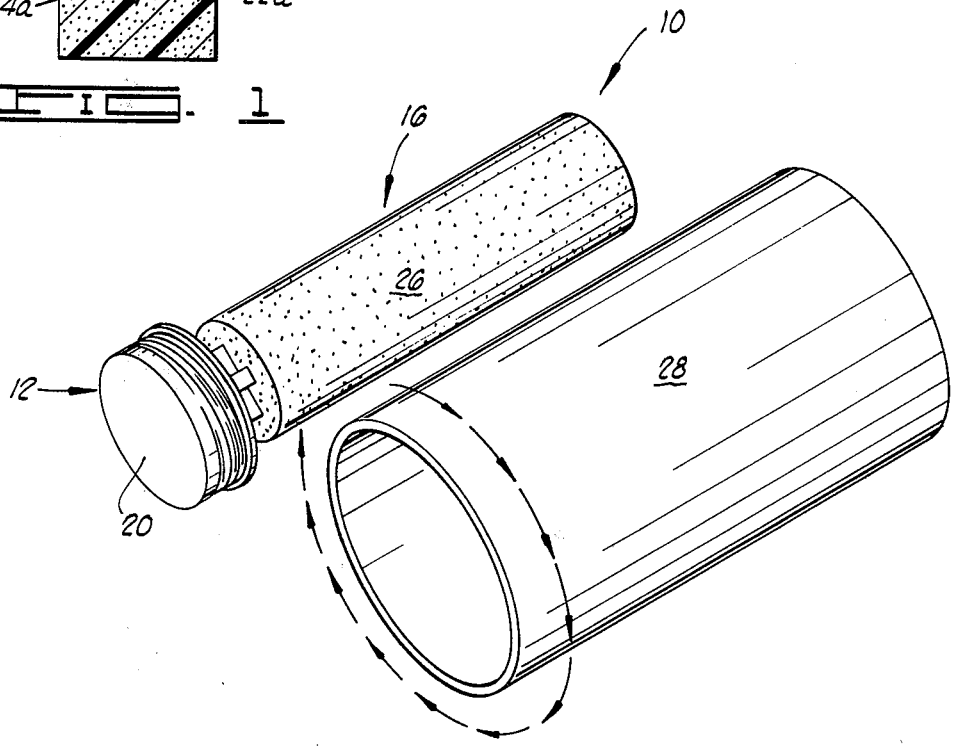
FIG. 3 is a perspective view illustrating the manner in which the adhesive applicator device of the invention is utilized in carrying out the method of the invention for the transfer of adhesive to a cylindrical surface.

The method of the present invention by which the adhesive applicator device 19 is most effectively used is demonstrated in FIG. 3 of the drawings. In this drawing, the applicator device 10 is shown in use for applying adhesive to the outer peripheral surface of a cylindrical member, such as pipe 28. A fitting could also be the article to which this adhesive is applied. The pad 26 has been, of course, initially loaded with adhesive by immersion in a body of adhesive in a container (not shown). The applicator device is then positioned adjacent the peripheral surface of the pipe 28, with contact being established along a line of tangency between the cylindrical surface of the pad 26 and the cylindrical surface of the pipe. At this time, adhesive is applied to the pipe 28 along this line in a uniform fashion, since the adhesive has been loaded substantially uniformly over the entire length and circumference of the adhesive pad.

For the purpose of applying a uniform layer of adhesive around the entire peripheral surface of the pipe 28, the applicator device 10 is next moved in a circular movement around the pipe, with the pipe being retained stationary against rotation about its longitudinal axis, and the adhesive applicator device also being maintained stationary against rotation about its longitudinal axis. The result of this movement about the periphery of the pipe 28 is that the line of contact between the peripheral surface of the pipe and the peripheral surface of the pad 26 continuously shifts around the peripheral surface of the cylindrical pad 26, exposing fresh adhesive to the surface of the pipe and accomplishing transfer of a very uniform layer of adhesive to the entire periphery of the pipe. The same mode of application is used in applying adhesive to the cylindrical internal walls of pipes and fittings.

The slight compression brought to bear upon the adhesive pad 26 during transfer of the adhesive causes the adhesive contained in the recesses **22*b* and 24*b* to be expelled and to be transferred outwardly through the pores or cells of the pad 26 to the outer periphery thereof. Moreover, as the line of contact moves around the periphery of the adhesive containing pad 26, that adhesive which has accumulated in the corners formed at the intersection of the webs 22 and 24 is also forced outwardly through the cells of the pad 26 to the outer periphery thereof. It will be noted that, due to the greater volume and length of the corner recesses which exist at the intersection of the webs 22 and 24, more adhesive will have been accumulated in this location than is accumulated in the several spaced notches or recesses 22*b* and 24*b*. These notches are however, disposed closer to the outer peripheral surface of the pad 26 than the corners formed by the intersections of the webs 22 and 24. The result is that there is a balance of flow distance and volume considerations such that adhesive tends to be transferred outwardly through the cells of the pad 26 to the outer periphery thereof in a uniform fashion over the entire periphery of the pad as the pad is moved about the pipe 28 in contact therewith, and the line of contact shifts about the periphery of the pad. The x-shaped cross-sectional configuration of the shaft also provides the advantage of imparting high mechanical strength to the shaft, while affording the maximum volume of the pad 26** as available for adhesive loading.

Although a preferred embodiment of the invention has been herein described, it will be understood that various changes of structure can be effected without departure from the basic principles of the invention. For example, although open-celled polyurethane has been described as a preferred material of construction for fabricating the pad 26, other types of open-celled synthetic resins can be used, provided the free transfer and wicking action important to the function of the invention is realized therefrom, and provided that the synthetic resin employed is inert with respect to, and insoluble in, the adhesive used. Other such changes can be envisioned which can be made without departure from, or relinquishment of, the basic principles of the invention. Changes and innovations of this type are therefore deemed to be circumscribed by the spirit and scope of the invention, except as the same may be necessarily limited by the appended claims, or reasonable equivalents thereof.

What is claimed is:

1. An adhesive applicator device comprising:

an elongated shaft of x-shaped transverse section, said shaft including a first elongated web having parallel side edges and having a plurality of spaced notches in each of said side edges, said notches each terminating in innermost portions positioned closer to one end of said shaft than is the opening to the respective notch;

a second elongated web intersecting said first web along the longitudinal axis of the shaft to form said x-shaped transverse section, said second web having parallel side edges;

a mounting plate secured to the opposite end of said shaft from said one end; and a generally cylindrical porous, resilient applicator pad having an x-shaped slot therein along the central axis thereof and extending from one end of the pad over a major portion of the length thereof, said pad receiving said shaft in said slot and resiliently engaging said shaft.

2. An adhesive applicator device as defined in claim 1 wherein said cylindrical applicator pad is open-celled foamed synthetic resin.

3. An adhesive applicator device as defined in claim 1 wherein said shaft and mounting plate are integrally formed of a synthetic resin as a single unit.

4. An adhesive applicator device as defined in claim 1 wherein said second elongated web is further characterized in including a plurality of spaced notches in each of said side edges of each of said webs, each of said notches in said second web side edges terminating in innermost portions positioned closer to said one end of said shaft than is the opening to the respective notch.

5. An adhesive applicator device as defined in claim 1 wherein each of said webs is characterized in having beveled end edges tapering to a point at the end of the shaft and intersecting the side edges of the respective web.

6. An adhesive applicator device as defined in claim 3 and further characterized as including a threaded container cap secured to said mounting plate for suspending said shaft and pad in a container of adhesive capped by said cap.

7. An adhesive applicator device as defined in claim 2 wherein the material of construction of said pad is open-celled polyurethane.

8. An adhesive applicator device as defined in claim 6 wherein said cylindrical applicator pad is open-celled foam synthetic resin.

9. An adhesive applicator device as defined in claim 8 wherein said adhesive applicator device is further characterized in including a plurality of spaced notches in each of said side edges of each of said webs, each of said notches in said side edges of said second web terminating in innermost portions positioned closer to one end of said shaft than is the opening to said respective notch.

10. An adhesive applicator device as defined in claim 9, wherein each of said webs is characterized in having beveled end edges tapering to a point at the end of said shaft and intersecting the side edges of the respective web.

11. An adhesive applicator device as defined in claim 10 wherein the material of construction of said pad is open-celled polyurethane.

12. An adhesive applicator device comprising:

a plurality of elongated webs intersecting and joined along a common line of intersection extending parallel to the longitudinal axis of each of the webs, said webs collectively forming an elongated shaft having its longitudinal axis extending along said line of intersection of the webs;

said webs each having side edges extending over a major portion of the length of said shaft, and said webs each having a tapered end edge at one end thereof intersecting a side edge of the respective web, said end edges converging with each other to provide a pointed end at one end of said shaft, and said side edges having a plurality of notches therein extending toward said common line of intersection;

a handle portion secured to the opposite end of said web-formed elongated shaft from the pointed end thereof; and a generally cylindrical porous, resilient applicator pad having a slot therein receiving said webs.

* * * * *